US011130156B2

(12) United States Patent
Tatsumoto et al.

(10) Patent No.: US 11,130,156 B2
(45) Date of Patent: Sep. 28, 2021

(54) VIBRATING SIEVE MACHINE

(71) Applicant: FUJINO INDUSTRIES CO., LTD., Settsu (JP)

(72) Inventors: Tatsunori Tatsumoto, Settsu (JP); Tetsuji Tanaka, Settsu (JP); Yoshihiro Ueno, Settsu (JP); Kiyosei Inaba, Settsu (JP)

(73) Assignee: FUJINO INDUSTRIES CO., LTD., Osaka (JP)

( * ) Notice: Subject to any disclaimer, the term of this patent is extended or adjusted under 35 U.S.C. 154(b) by 201 days.

(21) Appl. No.: 16/474,748

(22) PCT Filed: Oct. 10, 2018

(86) PCT No.: PCT/JP2018/037652
§ 371 (c)(1),
(2) Date: Jun. 28, 2019

(87) PCT Pub. No.: WO2019/082644
PCT Pub. Date: May 2, 2019

(65) Prior Publication Data

US 2019/0337018 A1 Nov. 7, 2019

(30) Foreign Application Priority Data

Oct. 25, 2017 (JP) ..... JP2017-004879 U
Oct. 25, 2017 (JP) ..... JP2017-004880 U

(51) Int. Cl.
*B07B 1/36* (2006.01)
*B07B 1/46* (2006.01)
*B07B 1/49* (2006.01)

(52) U.S. Cl.
CPC ..... *B07B 1/36* (2013.01); *B07B 1/4663* (2013.01); *B07B 1/49* (2013.01)

(58) Field of Classification Search
CPC ..... B07B 1/36; B07B 1/4663; B07B 1/49; B07B 1/06; B07B 1/38; B07B 1/48; B07B 1/28; B07B 1/46
See application file for complete search history.

(56) References Cited

U.S. PATENT DOCUMENTS 2,714,961 A * 8/1955 Miller ..... B07B 1/48 209/403
3,616,906 A * 11/1971 Miller ..... B07B 1/288 209/403

(Continued)

FOREIGN PATENT DOCUMENTS

CN 204148117 U 2/2015
DE 8713767 U1 12/1987

(Continued)

OTHER PUBLICATIONS

International Search Report for International Application No. PCT/JP2018/037652, dated Jan. 8, 2019.

(Continued)

*Primary Examiner* — Patrick H Mackey
(74) *Attorney, Agent, or Firm* — Pearne & Gordon LLP

(57) ABSTRACT

A vibrating sieve machine for applying vibrations on powder to be classified that is placed on a mesh member through a sieve frame including a plurality of separable sieve frames for sieving and classification, wherein the mesh member includes a circular annular mesh member frame having an outer peripheral surface and configured to be sandwiched by the separable sieve frames with the outer peripheral surface exposed outward in a radial direction of the separable sieve frames, a reinforcement mesh stretching across the mesh member frame, a sieve mesh configured to cover the reinforcement mesh, hanging down over an outer peripheral surface of the mesh member frame, and a fastening band configured to be attached to the outer peripheral surface of (Continued)

the mesh member frame so as to sandwich the sieve mesh between the fastening band and the outer peripheral surface of the mesh member frame.

10 Claims, 11 Drawing Sheets

(56) References Cited

U.S. PATENT DOCUMENTS

| | | | | | |
|---|---|---|---|---|---|
| 3,776,382 | A * | 12/1973 | Wright | B07B 1/49 | 209/403 |
| 4,929,346 | A | 5/1990 | Si-Lin | | |
| 7,182,206 | B2 * | 2/2007 | Hukki | B07B 1/42 | 209/365.1 |
| 8,485,364 | B2 * | 7/2013 | Krush | B07B 1/38 | 209/326 |

FOREIGN PATENT DOCUMENTS

| | | | | |
|---|---|---|---|---|
| EP | 0419033 | A1 * | 3/1991 | B07B 1/06 |
| EP | 0419033 | A1 | 3/1991 | |
| EP | 0706837 | A1 * | 4/1996 | B07B 1/4618 |
| EP | 0706837 | A1 | 4/1996 | |
| JP | H07-13464 | U | 3/1995 | |
| JP | 2002-346479 | A | 12/2002 | |
| JP | 2002346479 | A * | 12/2002 | B07B 1/06 |
| JP | 2007-333078 | A | 12/2007 | |
| JP | 3188460 | U | 12/2013 | |

OTHER PUBLICATIONS

Canadian Office Action dated Oct. 28, 2020 for corresponding Canadian patent application No. 3,045,878.
Extended European search report issued in European Patent Application No. 18870957.0 dated Jul. 13, 2020.
Chinese Office Action dated Jul. 12, 2021 for corresponding Chinese patent application No. 201880008284.5.

* cited by examiner

--PRIOR ART--

VIBRATING SIEVE MACHINE

TECHNICAL FIELD

The present invention relates to vibrating sieve machines for classifying, by vibrations, powders of various materials, such as medicines, foods, mineral products, metals, and resin raw materials. More particularly, the present invention relates to a vertical vibrating sieve machine capable of having a smaller body height.

BACKGROUND ART

A conventional vertical vibrating sieve machine is provided with a vibrating plate that is supported by a plurality of compression coil springs on a supporting table in a manner that allows the vibrating plate to vibrate. A sieve frame that holds a mesh member is fixed to the vibrating plate. A vibrating motor is provided on each of opposite sides in the horizontal direction of the sieve frame. When the opposite vibrating motors are operated, vibrations are applied through the sieve frame to powder to be classified that is placed on the mesh member for sieving and classification (see Patent Document 1).

CITATION LIST

Patent Literature

Patent Document 1: Japanese Registered Utilty Model No. 3188460

As shown in FIG. 11, in a vibrating sieve machine 100 described in Patent Document 1, a sieve frame 101 includes an upper separable sieve frame 101*a* and a lower separable sieve frame 101*b*, which can be vertically separated from each other. A mesh member 102 is disposed inside the sieve frame 101 at or near a boundary between the upper separable sieve frame 101*a* and the lower separable sieve frame 101*b*.

The mesh member 102 includes: a mesh member body 103 having a circular annular mesh member frame 104 and a reinforcement mesh 105 stretching across the mesh member frame 104; a sieve mesh 106 that is put on top of the mesh member body 103, covering the reinforcement mesh 105 and hanging down over an outer peripheral surface of the mesh member frame 104; and a fastening band 107 that is attached to the outer peripheral surface of the mesh member frame 104 so that the sieve mesh 106 is sandwiched between the outer peripheral surface of the mesh member frame 104 and the fastening band 107, whereby the sieve mesh 106 is tied and fixed to the mesh member body 103.

SUMMARY OF INVENTION

Technical Problem

However, in the conventional vibrating sieve machine 100, the mesh member frame 104, which does not substantially contribute to sieving and classification of powder to be classified, is entirely housed inside the sieve frame 101 (the upper separable sieve frame 101*a*). Therefore, the effective areas of the reinforcement mesh 105 and the sieve mesh 106, which substantially contribute to sieving and classification of powder, are reduced by the mesh member frame 104 disposed inside the sieve frame 101. This poses the problem that sieving and classification cannot efficiently be performed on powder to be classified. In addition, there is another problem that when the mesh member 102 and the sieve frame 101 are fitted together, the fastening band 107 of the mesh member 102 may interfere with the sieve frame 101.

With the above problems in mind, the present invention has been made. It is an object of the present invention to provide a vibrating sieve machine that can more efficiently perform sieving and classification on powder to be classified than in the conventional art, and in which a mesh member and a sieve frame can be fitted together without a fastening band interfering with the sieve frame.

Solution to Problem

To achieve the above object, a vibrating sieve machine according to the present invention comprises a sieve frame including a plurality of cylindrical separable sieve frames that are vertically separable from each other, and a mesh member configured to be held by the sieve frame. Vibrations are applied through the sieve frame to powder to be classified that is placed on the mesh member for sieving and classification. The mesh member includes a circular annular mesh member frame having an outer peripheral surface and configured to be sandwiched by the separable sieve frames with the outer peripheral surface exposed outward in a radial direction of the separable sieve frames, a reinforcement mesh stretching across the mesh member frame, a sieve mesh configured to cover the reinforcement mesh, hanging down over an outer peripheral surface of the mesh member frame, and a fastening band configured to be attached to the outer peripheral surface of the mesh member frame so as to sandwich the sieve mesh between the fastening band and the outer peripheral surface of the mesh member frame.

In this vibrating sieve machine, the mesh member frame is sandwiched by the plurality of separable sieve frames with the outer peripheral surface of the mesh member frame exposed outward in the radial direction of the separable sieve frames. Therefore, compared to the conventional vibrating sieve machine 100 in which the mesh member frame 104, which does not substantially contribute to sieving and classification of powder to be classified, is entirely disposed inside the sieve frame 101 (the upper separable sieve frame 101*a*) (see FIG. 11), the effective areas of the reinforcement mesh and the sieve mesh, which substantially contribute to powder sieving and classification, increase, and the fastening band attached to the outer peripheral surface of the mesh member frame is exposed outward in the radial direction of the separable sieve frames. Therefore, powder to be classified can be more efficiently sieved and classified than in the conventional art, and the mesh member and the sieve frame can be fitted together without the fastening band interfering with the sieve frame.

In the vibrating sieve machine of the present invention, the mesh member frame preferably has a sandwich surface portion configured to be sandwiched by the separable sieve frames, and the sandwich surface portion preferably has a warped shape that is sloped upward as one progresses radially outward in a direction away from the center of the mesh member frame.

In this vibrating sieve machine, when the mesh member frame having such a warpage is sandwiched by the plurality of separable sieve frames, the mesh member frame is deformed such that the warpage is eliminated. As a result, the entire sieve mesh is pulled outward in the radial direction of the mesh member frame. As a result, the sieve mesh that is put on top of the mesh member frame, covering the reinforcement mesh, is tightly attached to the reinforcement mesh with high tension maintained. Therefore, the sieve mesh is stably supported by the reinforcement mesh, and thereby exhibits sufficient classification performance.

In the vibrating sieve machine of the present invention, the fastening band preferably includes a band member configured to be wrapped around the outer peripheral surface of the mesh member frame so as to sandwich the sieve mesh between the band member and the outer peripheral surface of the mesh member frame, and a band diameter adjustment mechanism attached to an outer peripheral surface of the band member and configured to adjust the size of a band diameter of the band member.

In this vibrating sieve machine, the size of the band diameter of the band member wrapped around the outer peripheral surface of the mesh member frame so as to sandwich the sieve mesh between the band member and the outer peripheral surface of the mesh member frame is adjusted by the band diameter adjustment mechanism. Therefore, even if a sieve mesh having a different mesh or wire diameter is used, the sieve mesh can be easily tied and fixed to the mesh member frame by the fastening band.

In the vibrating sieve machine of the present invention, the band diameter adjustment mechanism preferably includes a housing attached to an end of the band member, a spindle rotatably supported by the housing and having worm teeth disposed in the housing, and a plurality of worm grooves disposed at the other end of the band member and configured to engage with the worm teeth. The fastening band is preferably allowed to be removed from the mesh member frame by operating the spindle so as to disengage the worm teeth from the worm grooves.

The band diameter adjustment mechanism may be positioned to interfere with a member around the sieve frame such as a fastening element for fastening the upper separable sieve frame and the lower separable sieve frame together when the mesh member and the sieve frame are fitted together and the vibrating sieve machine is actuated. In this case, it is not necessary to disassemble the sieve frame and rearrange the mesh member so that the band diameter adjustment mechanism does not interfere with the fastening element or the like, which is a complicated operation. Instead, in this vibrating sieve machine, only the fastening band is removed from the mesh member frame, and the band diameter adjustment mechanism is rearranged and attached again so as not to interfere with the fastening element or the like. Thus, the band diameter adjustment mechanism can be easily prevented from interfering with the fastening element or the like.

In the vibrating sieve machine of the present invention, the separable sieve frames preferably include an upper separable sieve frame and a lower separable sieve frame configured to be disposed vertically adjacent to each other. The upper separable sieve frame preferably has a body and a flange protruding from a lower end of the body radially outward. The lower separable sieve frame preferably has a body and a flange protruding from an upper end of the body radially outward. The flanges of the upper separable sieve frame and the lower separable sieve frame are preferably configured to sandwich the mesh member frame.

In this vibrating sieve machine, the flange protruding from the lower end of the body of the upper separable sieve frame radially outward, and the flange protruding from the upper end of the body of the lower separable sieve frame, vertically sandwich the mesh member frame from above and below. Thus, while the entire mesh member frame is located outside the bodies of the upper separable sieve frame and the lower separable sieve frame, the reinforcement mesh and the sieve mesh, which substantially contribute to sieving and classification of powder to be classified, are disposed throughout the interior of the bodies of the upper separable sieve frame and the lower separable sieve frame. As a result, the effective areas of the reinforcement mesh and the sieve mesh, which contribute to sieving and classification of powder, can be maximized, so that powder to be classified can be more efficiently sieved and classified.

The vibrating sieve machine of the present invention preferably further comprises a packing attached to each of the flanges of the upper separable sieve frame and the lower separable sieve frame and configured to be tightly attached to the mesh member.

In this vibrating sieve machine, the mesh member is tightly attached to each of the flanges of the upper separable sieve frame and the lower separable sieve frame with the packing interposed therebetween. Therefore, powder to be classified can be reliably prevented from leaking through an interstice between each separable sieve frame and the mesh member.

In the vibrating sieve machine of the present invention, the mesh member frame preferably has an upper circular annular plate surface portion and a lower circular annular plate surface portion vertically separated from each other with a predetermined space interposed therebetween and configured to be sandwiched by the separable sieve frames, an outer cylindrical portion connecting outer peripheral edges of the upper circular annular plate surface portion and the lower circular annular plate surface portion together, and an inner cylindrical portion connecting inner peripheral edges of the upper circular annular plate surface portion and the lower circular annular plate surface portion. The mesh member frame is preferably formed by bending a polygonal tube material having a quadrangular annular cross-section into a circular ring.

In this vibrating sieve machine, the mesh member can easily have a lighter weight, and a strength such that the mesh member is not crushed to the extent that the mesh member can no longer be used, when the mesh member is sandwiched by the separable sieve frames.

In the vibrating sieve machine of the present invention, the mesh member frame preferably has a circular annular plate surface portion configured to be sandwiched by the separable sieve frames, and an outer cylindrical portion protruding downward from an outer peripheral edge of the circular annular plate surface portion. The mesh member frame is preferably formed by bending an angle material having an L-shaped cross-section into a circular ring.

In this vibrating sieve machine, the circular annular plate surface portion, whose structure does not have a hollow portion, of the mesh member frame is sandwiched by the plurality of separable sieve frames so that the mesh member is fixed to the sieve frame. Therefore, when the mesh member is fixed to the sieve frame, the mesh member frame can be reliably prevented from being crushed and deformed to the extent that the mesh member can no longer be used. As a result, the tension of the sieve mesh tied and fixed to the mesh member frame can be prevented from being reduced due to the deformation of the mesh member frame.

In the vibrating sieve machine of the present invention, the mesh member frame preferably has an outer diameter of 400-1140 mm and an inner diameter of 352-1080 mm. A magnitude of the warpage of the mesh member frame is preferably defined by a height difference between one end and the other end of the sandwich surface portion in the radial direction of the mesh member frame, and the height difference is 0.5-1.5 mm.

In this vibrating sieve machine, when the mesh member frame having such a warpage is sandwiched by the plurality of separable sieve frames, so that the mesh member frame is deformed such that the warpage is eliminated, the entire sieve mesh is pulled outward in the radial direction of the mesh member frame with appropriate tension. As a result, the sieve mesh can be tightly attached to the reinforcement mesh without being damaged and with high tension maintained.

DESCRIPTION OF EMBODIMENTS

Figure 1A:
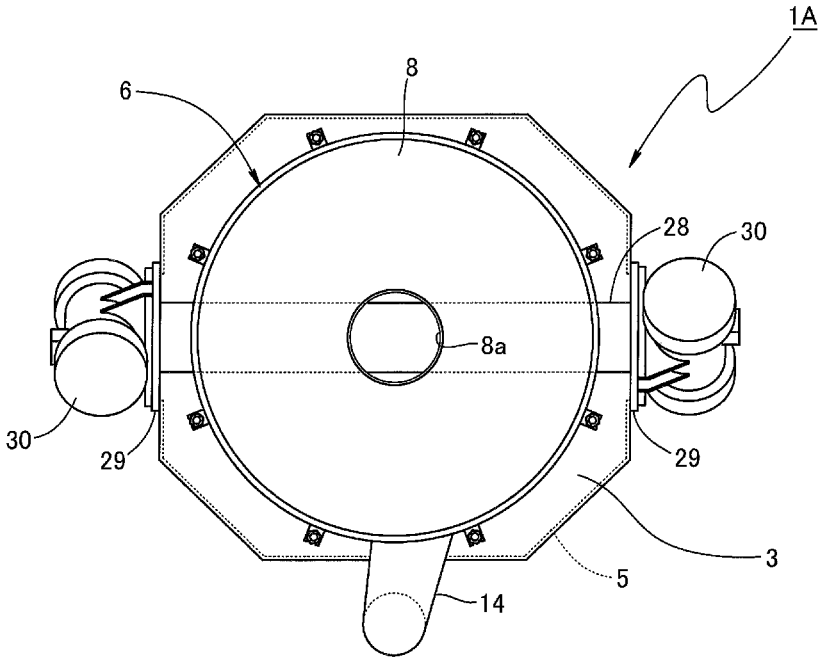
FIG. 1A and FIG. 1B are diagrams showing a vibrating sieve machine according to a first embodiment of the present invention, including a plan view FIG. 1A and a front view FIG. 1B thereof.

Specific embodiments of a vibrating sieve machine according to the present invention will now be described with reference to the accompanying drawings. Note that the present invention is in no way intended to be limited to embodiments described below or configurations shown in the drawings.

First Embodiment

Figure 1B:
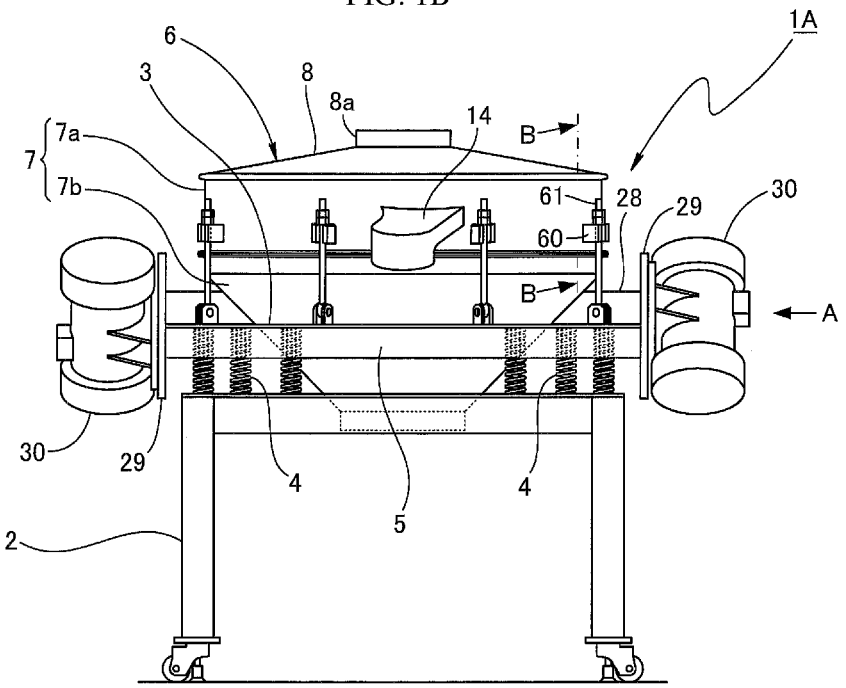
Figure 2A:
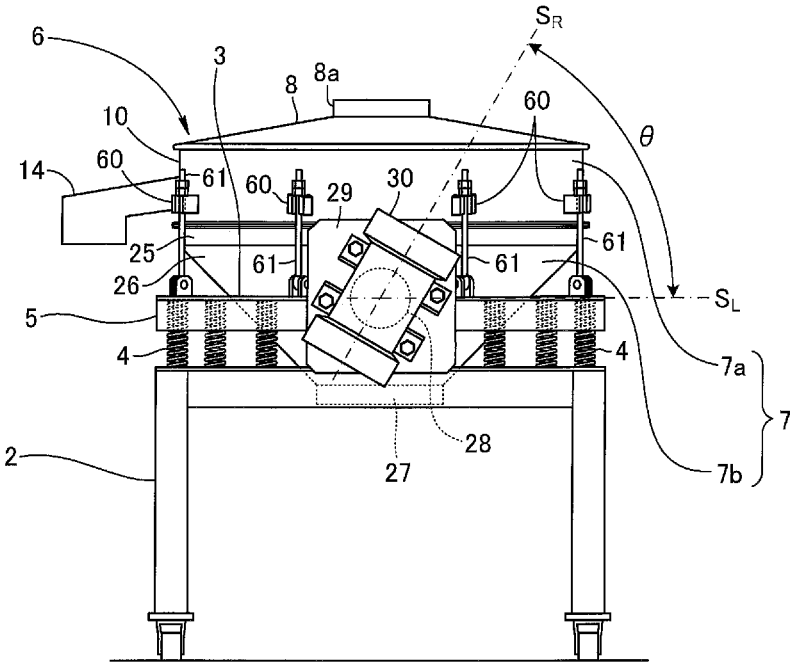
FIG. 2A and FIG. 2B are diagrams showing the vibrating sieve machine of the first embodiment, including a view FIG. 2A thereof taken in a direction indicated by arrow A of FIG. 1B and a cross-sectional view FIG. 2B thereof taken along line B-B of FIG. 1B.
Figure 2B:
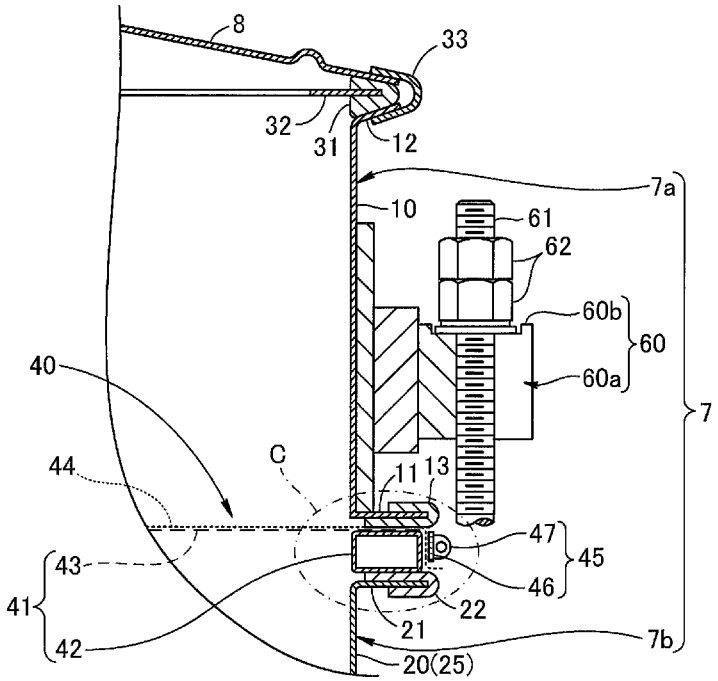

FIG. 1A and FIG. 1B are diagrams showing a vibrating sieve machine according to a first embodiment of the present invention, including a plan view FIG. 1A and a front view FIG. 1B thereof. FIG. 2A and FIG. 2B are diagrams showing the vibrating sieve machine, including a view FIG. 2A thereof taken in a direction indicated by arrow A of FIG. 1B and a cross-sectional view FIG. 2B thereof taken along line B-B of FIG. 1B.

<Overview of Vibrating Sieve Machine>

As shown in FIG. 1A and FIG. 1B, the vibrating sieve machine 1A of the first embodiment is of a vertical type in which the body height can be reduced. The vibrating sieve machine 1A has the function of vibrating and classifying powders of various materials, such as medicines, foods, mineral products, metals, and resin raw materials. The vibrating sieve machine 1A includes a vibrating plate 3 disposed above a supporting table 2.

<Vibrating Plate>

The vibrating plate 3 is a plate-shaped member having a predetermined thickness and in the shape of an octagonal ring having an attachment hole for attaching a sieve container 6 described below, at a center thereof, as viewed from above. A plurality of (in this example, 12) compression coil springs (elastic supports) 4 are provided between the vibrating plate 3 and the supporting table 2, and are disposed in a peripheral direction of the vibrating plate 3 at predetermined positions. The vibrating plate 3 is supported and allowed by the compression coil springs 4 to vibrate.

A reinforcement plate 5 is provided along an outer peripheral edge of the vibrating plate 3. The reinforcement plate 5 is formed by bending a band-shaped plate material so that the plate 5 fits the shape of the outer peripheral edge of the vibrating plate 3. The reinforcement plate 5 is firmly attached to the vibrating plate 3, extending along substantially the entire perimeter of the vibrating plate 3, and protruding vertically downward from the lower plate surface of the vibrating plate 3. As a result, the stiffness of the vibrating plate 3 can be improved while an increase in the weight of the vibrating plate 3 is inhibited. Therefore, even in the case where a high-power vibrating motor 30 is employed, the vibrating plate 3 can be prevented from bending or twisting. Thus, a high-power vibrating motor 30 can be employed, resulting in an improvement in classification capability.

<Sieve Container>

A sieve container 6 is held in the attachment hole of the vibrating plate 3. The sieve container 6 includes, as main components, a sieve frame 7 having a vertical opening through which powder to be classified is introduced, and a lid 8 that is removably attached to an upper opening of the sieve frame 7. An introduction opening 8*a* for powder to be classified is formed at a center portion of the lid 8.

<Sieve Frame>

As shown in FIG. 2A and FIG. 2B, the sieve frame 7 is formed by fitting together an upper separable sieve frame 7*a* and a lower separable sieve frame 7*b*, which can be vertically separated from each other.

As shown in FIG. 2B, the upper separable sieve frame 7*a* includes a cylindrical upper separable sieve frame body 10 having a vertical opening, a flange 11 extending all around the upper separable sieve frame body 10 and protruding radially outward from a lower end of the upper separable sieve frame body 10, and a tapered flange 12 extending all around the upper separable sieve frame body 10 and protruding outward and diagonally upward from an upper end of the upper separable sieve frame body 10. A circular annular packing 13 is attached to the flange 11 of the upper separable sieve frame 7*a*, extending all around the upper separable sieve frame body 10.

As shown in FIG. 2A, a discharge duct 14 is attached to a portion of the upper separable sieve frame 7*a* on one side in the horizontal direction (the left side in FIG. 2A), projecting from a cylindrical wall surface of the upper separable sieve frame body 10. The discharge duct 14 has the function of guiding, to the outside, residual powder remaining on a mesh member 40 described below during a classification process.

As shown in FIG. 2B, the lower separable sieve frame 7*b* includes a lower separable sieve frame body 20, and a flange 21 extending all around the lower separable sieve frame body and protruding radially outward from an upper end of the lower separable sieve frame body 20. The flange 21 corresponds to the flange 11 of the upper separable sieve frame 7*a*. A circular annular packing 22 is attached all around the flange 21 of the lower separable sieve frame 7*b*.

The lower separable sieve frame body 20 has a cylindrical section 25 in the shape of a cylinder having a vertical opening. As shown in FIG. 2A, a funnel-shaped chute section 26 that becomes gradually narrower downward is provided below the cylindrical section 25. The chute section 26 is integrally formed with the cylindrical section 25 so as to be continuously connected to the cylindrical section 25. An outlet section 27 through which powder in the chute section is dropped and discharged downward is provided below the chute section 26. The outlet section 27 is integrally formed with the chute section 26 so as to be continuously connected to the chute section 26.

<Vibrating Motor>

As shown in FIG. 1A and FIG. 1B, the lower separable sieve frame 7*b* is provided with a beam member 28 penetrating therethrough in the horizontal direction. A motor attachment plate 29 is firmly joined to either end of the beam member 28. A vibrating motor 30 is attached to each motor attachment plate 29. Each vibrating motor 30 generates vibrations by rotation of eccentric weights provided at opposite ends of the rotor shaft, although such a mechanism is not shown and will not be described in detail.

As shown in FIG. 2A, in each vibrating motor 30, an angle θ between an axial line $S_R$ of the rotor shaft and a horizontal axial line $S_L$ is in the range of 55-65°. In this example, the axial line $S_R$ of the rotor shaft is sloped at θ=60°. Note that the opposite vibrating motors 30 are disposed so that one vibrating motor 30 and the other vibrating motor 30 have opposite phases, i.e., the images of one vibrating motor 30 and the other vibrating motor 30 projected onto a vertical plane from the direction of one of opposite sides, are symmetrical about a horizontal angle (i.e., one vibrating motor 30 and the other vibrating motor 30 are inclined in opposite directions at equal angles). Thus, a vibration component in the vertical direction can be maximized while a required vibration component in the horizontal direction is ensured. A resultant wave motion causes powder on a mesh member 40 described below to significantly jump upward and strike meshes 43 and 44 described below, so that powder particle aggregations are disintegrated or crushed and dispersed, resulting in a further improvement in classification capability.

<Joint Structure of Lid and Upper Separable Sieve Frame>

As shown in FIG. 2B, a lid packing 31 is interposed between an outer peripheral edge of the lid 8 and the tapered flange 12 of the upper separable sieve frame 7*a* to seal an interstice therebetween with the lid packing 31 supported on a ring plate 32. A fastening band 33 is wrapped around a portion where the lid 8 abuts the upper separable sieve frame 7*a*. The fastening band 33 has such a V cross-sectional shape as to bind the outer peripheral edge of the lid 8 and the tapered flange 12 of the upper separable sieve frame 7*a* together. The binding by the fastening band 33 can fasten the lid 8 and the upper separable sieve frame 7*a* to each other. When the binding by the fastening band 33 is removed, the lid 8 can be detached from the upper separable sieve frame 7*a*.

<Mesh Member>

As shown in FIG. 2B, a mesh member 40 is held between the upper separable sieve frame 7*a* and the lower separable sieve frame 7*b* of the sieve frame 7. The mesh member 40 includes, as main components, a mesh member frame 42 and a reinforcement mesh 43 constituting a mesh member body 41, a sieve mesh 44, and a fastening band 45.

<Mesh Member Frame>

Figure 3:
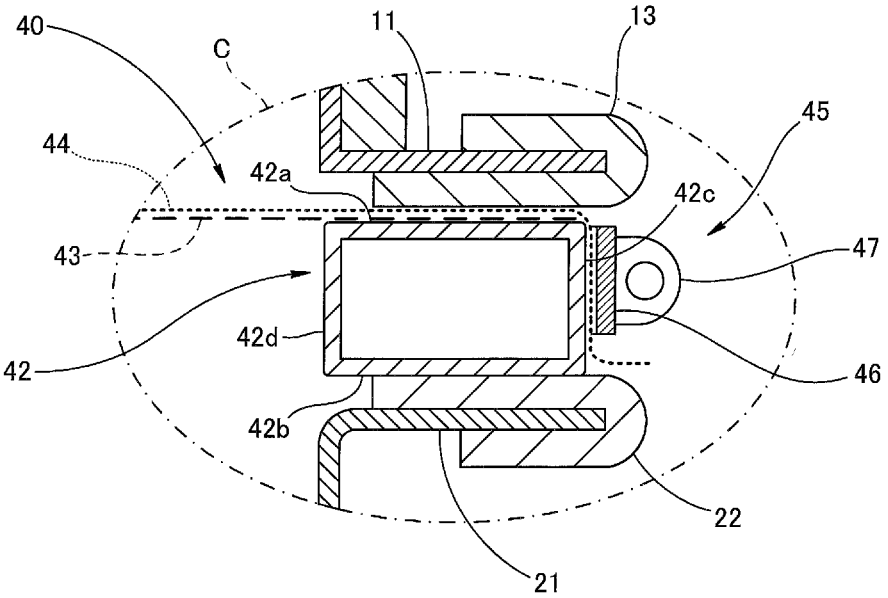
FIG. 3 is an enlarged view of a portion C of FIG. 2B.

As shown in FIG. 3, the mesh member frame 42 has an upper circular annular plate surface portion 42*a*, a lower circular annular plate surface portion 42*b*, an outer cylindrical portion 42*c*, and an inner cylindrical portion 42*d*. The mesh member frame 42 is formed by bending a polygonal tube material having a quadrangular annular cross-section into a circular ring. Thus, the mesh member 40 can easily have a lighter weight, and a strength such that the mesh member 40 is not crushed to the extent that the mesh member 40 can no longer be used, when the mesh member 40 is sandwiched by the separable sieve frames 7*a* and 7*b*.

When the mesh member frame 42 is sandwiched by the separable sieve frames 7*a* and 7*b*, the upper circular annular plate surface portion 42*a* faces the flange 11 of the upper separable sieve frame 7*a*, the lower circular annular plate surface portion 42*b* faces the flange 21 of the lower separable sieve frame 7*b*, and the circular annular plate surface portions 42*a* and 42*b* are sandwiched by the flanges 11 and 21 of the separable sieve frames 7*a* and 7*b* with the packings 13 and 22 interposed therebetween. Thus, while the entire mesh member frame 42 is located outside the separable sieve frame bodies 10 and 20, the reinforcement mesh 43 and the sieve mesh 44, which substantially contribute to sieving and classification of powder to be classified, are disposed throughout the interior of the upper and lower separable sieve frame bodies 10 and 20. As a result, the effective areas of the reinforcement mesh 43 and the sieve mesh 44, which contribute to sieving and classification of powder, can be maximized, so that powder to be classified can be more efficiently sieved and classified. In addition, the packings and 22 can reliably prevent powder to be classified from leaking through an interstice between the separable sieve frames 7*a* and 7*b* and the mesh member 40. Note that the upper circular annular plate surface portion 42*a* and the lower circular annular plate surface portion 42*b* correspond to a "sandwich surface portion" of the present invention.

The outer cylindrical portion 42*c* joins outer peripheral edges of the upper circular annular plate surface portion 42*a* and the lower circular annular plate surface portion 42*b* together, and faces outward in the radial direction of the separable sieve frames 7*a* and 7*b*. Meanwhile, the inner cylindrical portion 42*d* is disposed so as to join inner peripheral edges of the upper circular annular plate surface portion 42*a* and the lower circular annular plate surface portion 42*b*, and face inward in the radial direction of the separable sieve frames 7*a* and 7*b*.

Figure 5A:
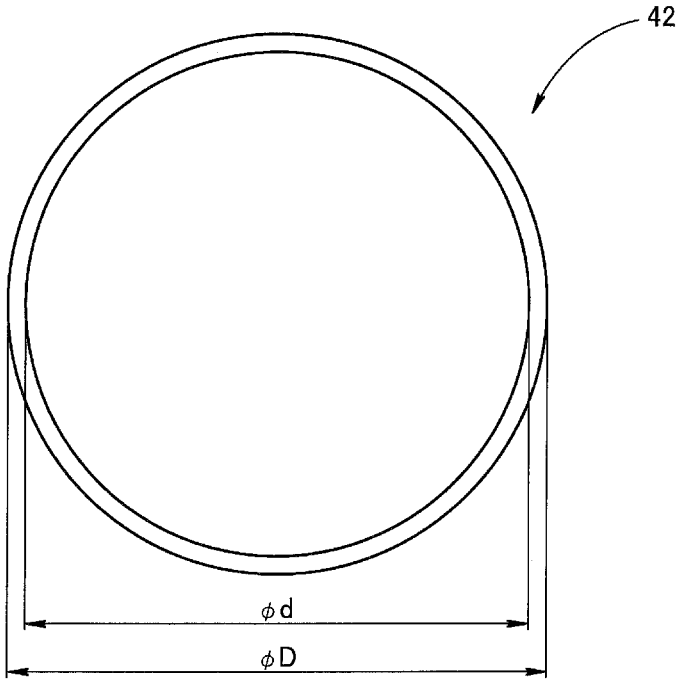
FIG. 5A, FIG. 5B and FIG. 5C are diagrams showing a mesh member frame used in the vibrating sieve machine of the first embodiment, including a plan view FIG. 5A thereof, a vertical cross-sectional view FIG. 5B thereof, and a schematic diagram FIG. 5C thereof for describing an operation of pulling a sieve mesh.

As shown in FIG. 5A, an outer diameter (D) and an inner diameter (d) of the mesh member frame 42 are set in the range of 400-1140 mm and 352-1080 mm, respectively.

Figure 5B:
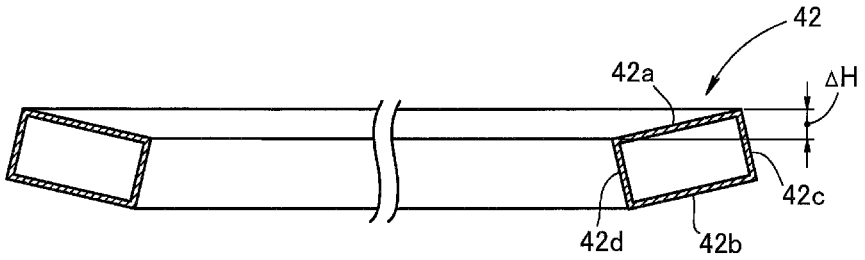

As shown in FIG. 5B, the mesh member frame 42 is formed in a warped shape. Specifically, the circular annular plate surface portions 42*a* and 42*b*, which are to be sandwiched by the flanges 11 and 21 of the separable sieve frames 7*a* and 7*b*, are sloped upward as one progresses radially outward, i.e. in a direction away from the center of the mesh member frame 42. The magnitude of the warpage of the mesh member frame 42 is defined by a height difference ΔH between one end and the other end of the circular annular plate surface portion 42*a*, 42*b* in the radial direction of the mesh member frame 42. The height difference ΔH is set to 0.5-1.5 mm. Note that, for the sake of convenience, FIG. 5B shows only the height difference ΔH of the upper circular annular plate surface portion 42*a*, and the magnitude of the warpage of the mesh member frame 42 is defined by that height difference. Alternatively, the magnitude of the warpage of the mesh member frame 42 may be defined by the height difference of the lower circular annular plate surface portion 42*b*.

Figure 5C:
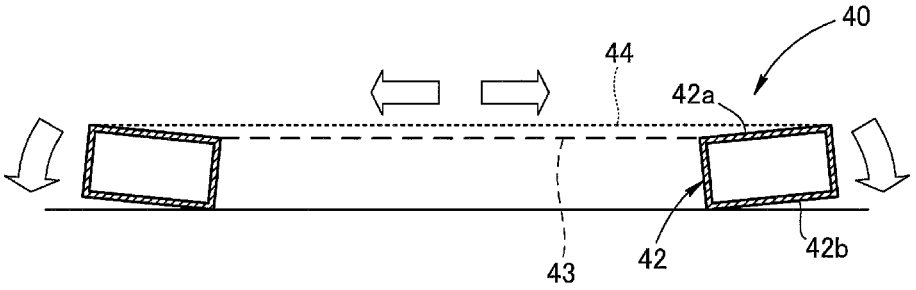

When the mesh member frame 42 having such a warpage is sandwiched by the flanges 11 and 21 of the separable sieve frames 7*a* and 7*b*, the mesh member frame 42 is deformed such that the warpage is eliminated. As a result, as shown in FIG. 5C, the entire sieve mesh 44 is pulled outward in the radial direction of the mesh member frame 42 with appropriate tension. As a result, the sieve mesh 44 that is put on top of the mesh member frame 42, covering the reinforcement mesh 43, is tightly attached to the reinforcement mesh 43 without being damaged and with high tension maintained. Therefore, the sieve mesh 44 is stably supported by the reinforcement mesh 43, and thereby exhibits sufficient classification performance.

<Reinforcement Mesh>

Figure 4A:
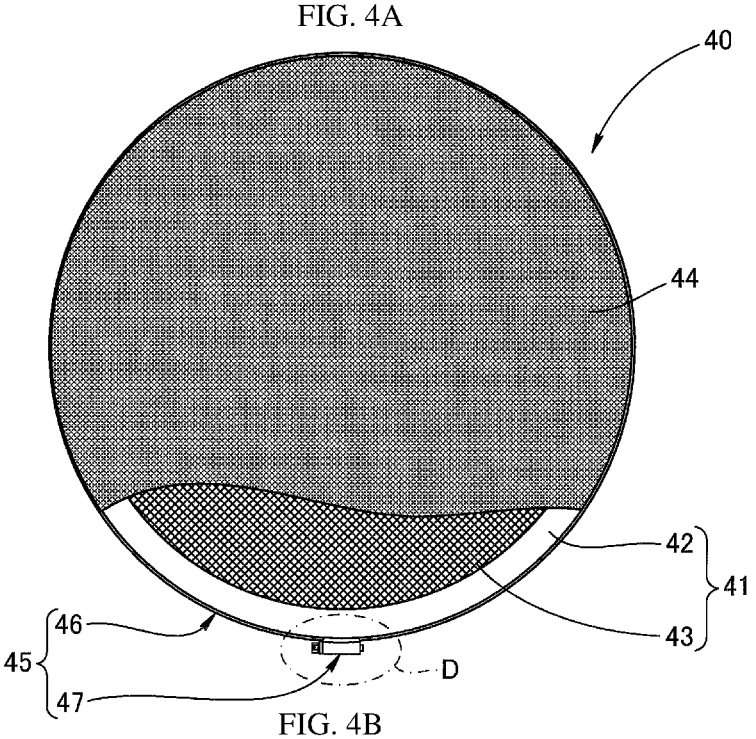
FIG. 4A, FIG. 4B and FIG. 4C are diagrams showing a mesh member used in the vibrating sieve machine of the first embodiment, including a plan view FIG. 4A thereof where a portion of a sieve mesh is cut away, an enlarged view FIG. 4B thereof showing a portion D of FIG. 4A, and a view FIG. 4C thereof taken in a direction indicated by arrow E of FIG. 4B.

As shown in FIG. 4A, the reinforcement mesh 43 stretches across the mesh member frame 42 to block the opening of the mesh member frame 42, and is firmly joined to an upper edge of the inner cylindrical portion 42*d* by a firmly joining means such as seam welding with the reinforcement mesh 43 stretching across the opening of the mesh member frame 42. The reinforcement mesh 43 may, for example, be a stainless-steel mesh having a relatively coarse mesh size.

<Sieve Mesh>

The sieve mesh 44 is put on top of the mesh member body 41, covering the reinforcement mesh 43 and hanging down over an outer peripheral surface of the mesh member frame 42 from above the reinforcement mesh 43. The sieve mesh 44 may, for example, be a sheet-shaped nylon mesh having a mesh size finer than that of the reinforcement mesh 43 (may, of course, be a stainless-steel mesh). The sieve mesh 44 is tied and fixed to the mesh member body 41 by the fastening band 45 wrapped around the outer peripheral surface of the mesh member frame 42 (the outer cylindrical portion 42*c*) fastening the sieve mesh 44 to the mesh member body 41 with the sieve mesh 44 interposed therebetween. The sieve mesh 44 is removably attached to the mesh member body 41 so that by loosening the fastening band 45, the sieve mesh 44 can be removed from the mesh member body 41.

Thus, the reinforcement mesh 43, which stretches across the mesh member frame 42, functions as a reinforcing material that supports the sieve mesh 44 from below. The sieve mesh 44 that is removably attached to the mesh member body 41, covering the reinforcement mesh 43, functions as a mesh that substantially contributes to a powder classification process. Therefore, the function of the mesh member 40 can be recovered only by replacing the sieve mesh 44, i.e. it is easy to perform mesh replacement.

<Fastening Band>

Figure 4B:
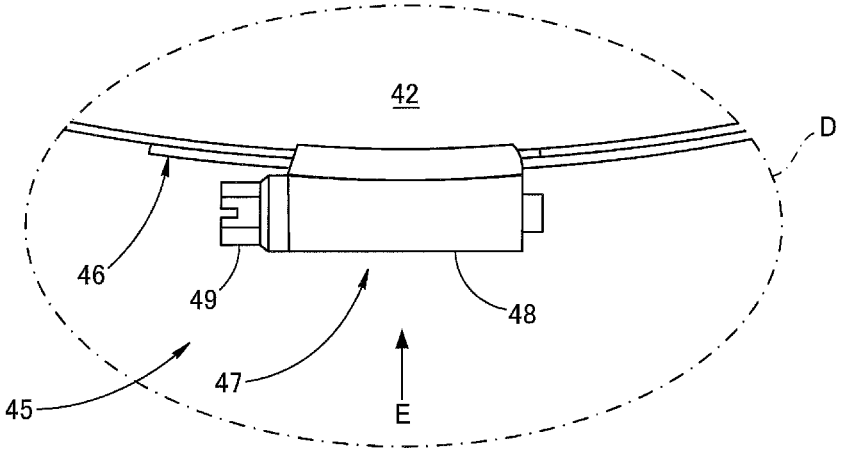
Figure 4C:
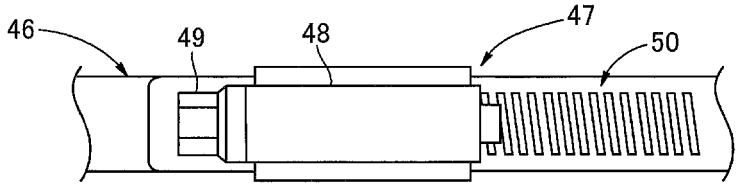

As shown in FIG. 4B and FIG. 4C, the fastening band 45 includes a band member 46 and a band diameter adjustment mechanism 47.

<Band Member>

The band member 46 is formed in a ring shape by bending so that the band member 46 can be wrapped around the outer peripheral surface of the mesh member frame 42 (outer cylindrical portion 42*c*) with the sieve mesh 44 interposed therebetween. The band member 46 is made of, for example, a metal material, such as stainless steel.

<Band Diameter Adjustment Mechanism>

The band diameter adjustment mechanism 47 is attached to an outer peripheral surface of the band member 46. The band diameter adjustment mechanism 47 includes a housing 48, a spindle 49, and a plurality of worm grooves 50. The band diameter adjustment mechanism 47 has the function of adjusting a band diameter of the band member 46. Here, the housing 48 is attached to one end (first end) of the band member 46. The spindle 49 has a shaft that is rotatably supported on the housing. The shaft has worm teeth (not shown) around an outer periphery thereof. The worm teeth are disposed inside the housing 48. The worm grooves 50 are provided at the other end (second end) of the band member 46, and are formed so as to engage with the worm teeth of the spindle 49.

In the band diameter adjustment mechanism 47, the second end of the band member 46 is inserted into the housing 48, and the spindle 49 is operated to cause the worm teeth of the spindle 49 to engage with the worm grooves 50, so that the fastening band 45 is allowed to act on the mesh member frame 42. In this situation, when the spindle 49 is rotated in a manner like fastening a bolt, the spindle 49 is screwed down by the worm teeth thereof engaging with the worm grooves 50 so that the second end of the band member 46 moves along the first end thereof, and therefore, the diameter of the band member 46 is reduced. As a result, an object to be tied (in this example, the sieve mesh 44) that is provided inside the band member 46 is fastened. Thus, even if a sieve mesh 44 having a different mesh or wire diameter is used, the sieve mesh 44 can be easily tied and fixed to the mesh member frame 42 by the fastening band 45.

In the band diameter adjustment mechanism 47, by operating the spindle 49 so as to disengage the worm teeth of the spindle 49 from the worm grooves 50, the fastening band 45 can be removed from the mesh member frame 42.

<Joint Structure of Upper Separable Sieve Frame and Lower Separable Sieve Frame>

As shown in FIG. 2A and FIG. 2B, a plurality of hook brackets 60 are provided on an outer peripheral surface of the upper separable sieve frame 7*a* at predetermined intervals in a peripheral direction of the upper separable sieve frame 7*a*, protruding from the outer peripheral surface of the upper separable sieve frame 7*a*. Each hook bracket 60 includes a reception opening 60*a* that is open outward in the radial direction of the upper separable sieve frame 7*a*, and a pair of hook portions 60*b* provided on the opposite sides of the reception opening 60*a*.

Swing bolts 61 are provided on an upper surface of the vibrating plate 3. Each swing bolt 61 can be swung between a horizontal position in which the swing bolt 61 is laid on the vibrating plate 3 and a vertical position in which the swing bolt 61 spans between the vibrating plate 3 and the hook bracket 60. The upper separable sieve frame 7*a* and the lower separable sieve frame 7*b* are fastened together by a nut screwing onto the swing bolt 61 in the vertical position and sitting on the hook bracket 60.

Thus, the upper separable sieve frame 7*a* and the lower separable sieve frame 7*b* are reliably fastened together by fastening the nut 62 to the swing bolt 61. Therefore, even if the amplitude in the vertical direction increases due to the use of the high-power vibrating motor 30, the joint portion of the upper separable sieve frame 7*a* and the lower separable sieve frame 7*b* can be prevented from becoming loose, and the loss of the vibrating motion in the vertical direction due to the looseness can be prevented. Even if the nut 62 is fastened to the swing bolt 61 with the sieve mesh 44 sticking out of a portion where the upper separable sieve frame 7*a* and the lower separable sieve frame 7*b* abut each other, the swing bolt 61 does not bite into the sieve mesh 44 to damage the sieve mesh 44, because the swing bolt 61 is not in direct contact with the abutting portion and is not fastened to the abutting portion, and an axial force is indirectly applied from the swing bolt 61 to the abutting portion through the upper separable sieve frame 7*a* and the lower separable sieve frame 7*b*.

<Mesh Replacement Operation>

Next, an operation of attaching the sieve mesh 44 involved in a mesh replacement operation for recovering the function of the mesh member 40 in the vibrating sieve machine 1A of the first embodiment, will be described.

Figure 6A:
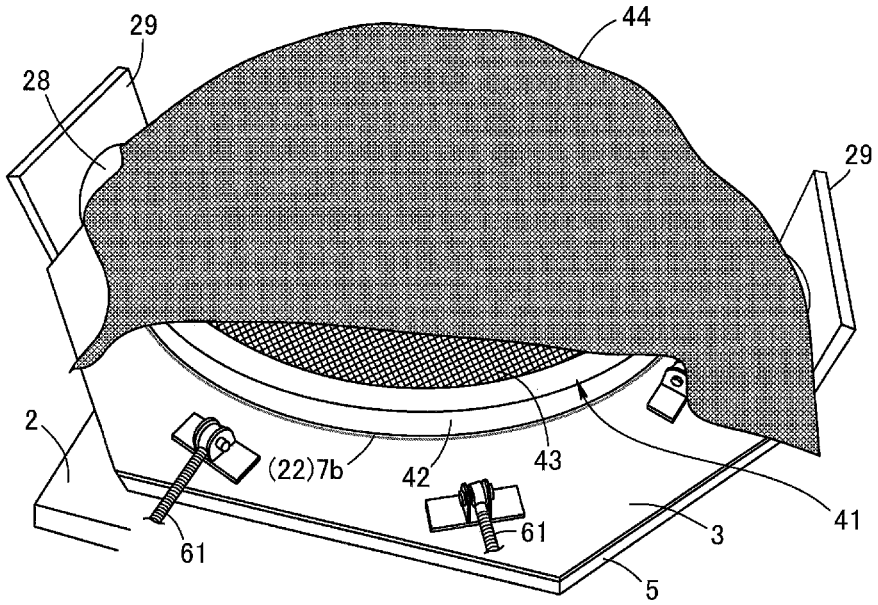
FIG. 6A and FIG. 6B are diagrams showing a mesh replacement operation procedure (1) for the vibrating sieve machine of the first embodiment.

Initially, as shown in FIG. 6A, the mesh member body 41 is placed on the packing 22 attached to the flange 21 of the lower separable sieve frame 7*b* with the mesh member frame 42 concentric with the lower separable sieve frame body 20 (see FIG. 2B).

Figure 6B:
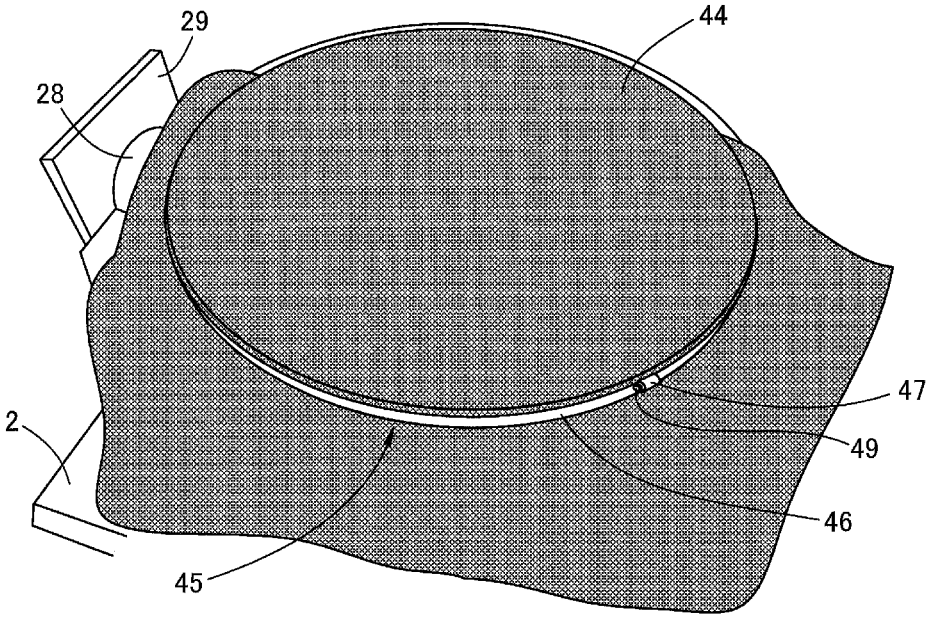
Figure 7A:
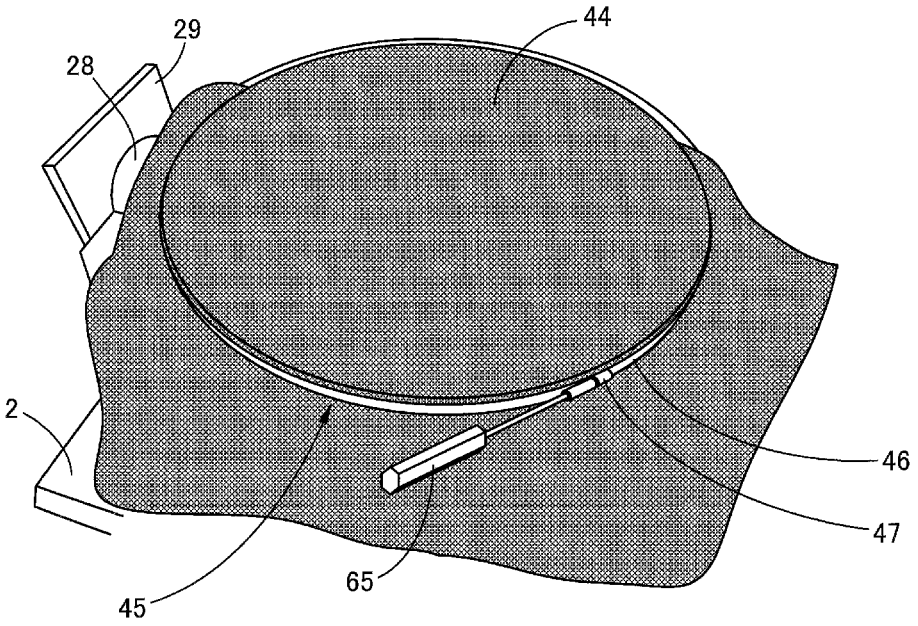
FIG. 7A and FIG. 7B are diagrams showing a mesh replacement operation procedure (2) for the vibrating sieve machine of the first embodiment.

Next, as shown in FIG. 6A and FIG. 6B, the sieve mesh 44 is put on top of the reinforcement mesh 43 of the mesh member body 41. The fastening band 45 is wrapped around the outer peripheral surface of the mesh member frame 42 so as to sandwich the sieve mesh 44 hanging down over the outer peripheral surface of the mesh member frame 42 (see FIG. 6A) from above the reinforcement mesh 43, between the fastening band 45 and the mesh member frame 42. As shown in FIG. 6B and FIG. 7A, the spindle 49 of the band diameter adjustment mechanism 47 is rotated in a manner like fastening a bolt, using a fastening tool 65, so as to reduce the diameter of the band member 46 of the fastening band 45 and thereby fasten the sieve mesh 44, so that the sieve mesh 44 is tied and fixed to the mesh member body 41 (the mesh member frame 42). Note that an excess portion of the sieve mesh 44 that sticks out of the fastening band 45 is cut as appropriate, or is folded up and then put into the interior of the upper separable sieve frame 7*a* when the upper separable sieve frame 7*a* is placed in an operation described below.

Figure 7B:
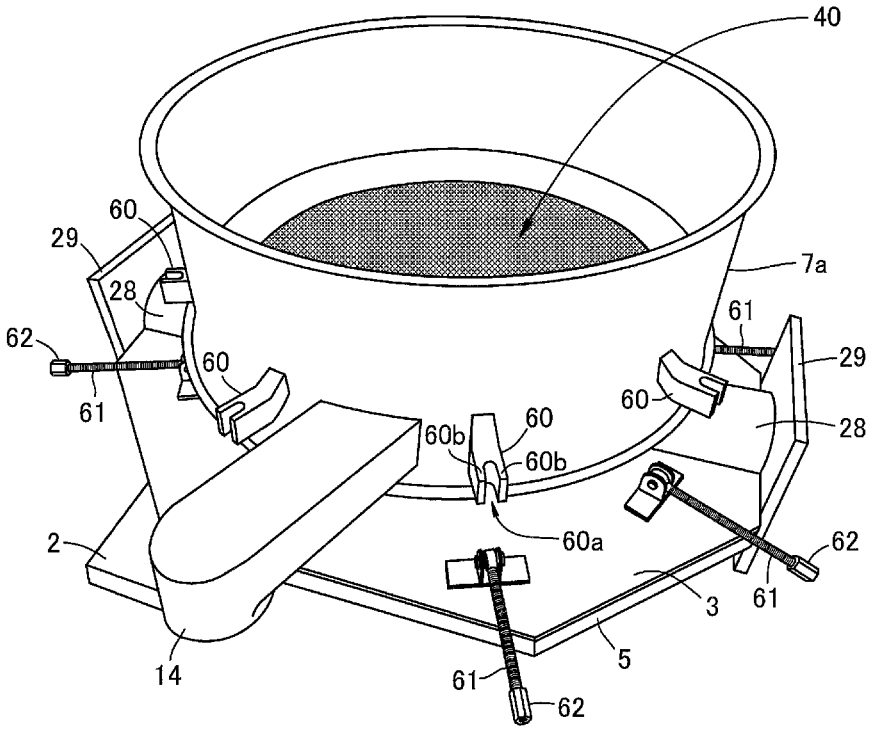

Next, as shown in FIG. 7B, the upper separable sieve frame 7*a* is placed on the mesh member 40 such that the packing attached to the flange 11 of the upper separable sieve frame 7*a* abuts the mesh member frame 42 with the sieve mesh 44 interposed therebetween, and the upper separable sieve frame body 10 is concentric with the mesh member frame 42.

Figure 8A:
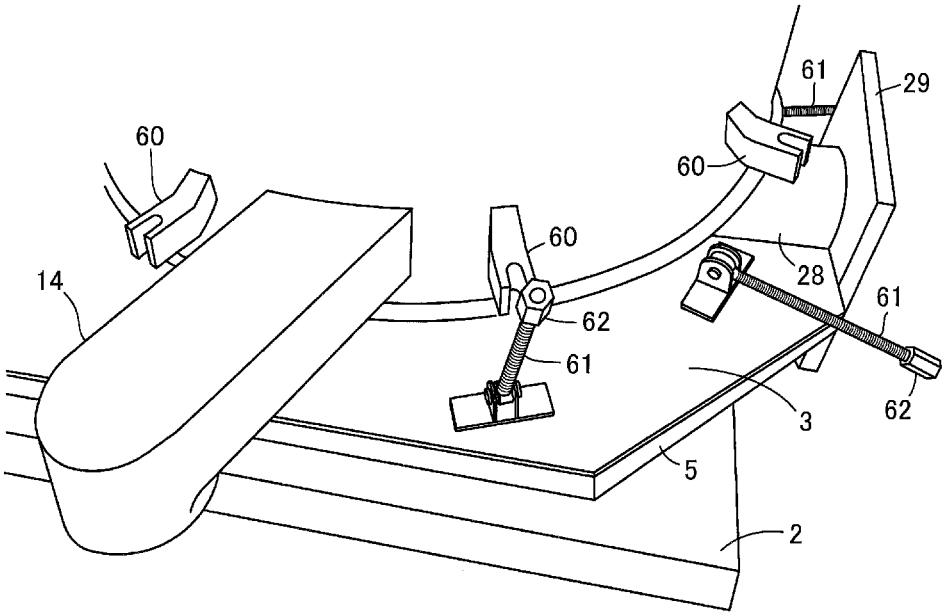
FIG. 8A and FIG. 8B are diagrams showing a mesh replacement operation procedure (3) for the vibrating sieve machine of the first embodiment.
Figure 8B:
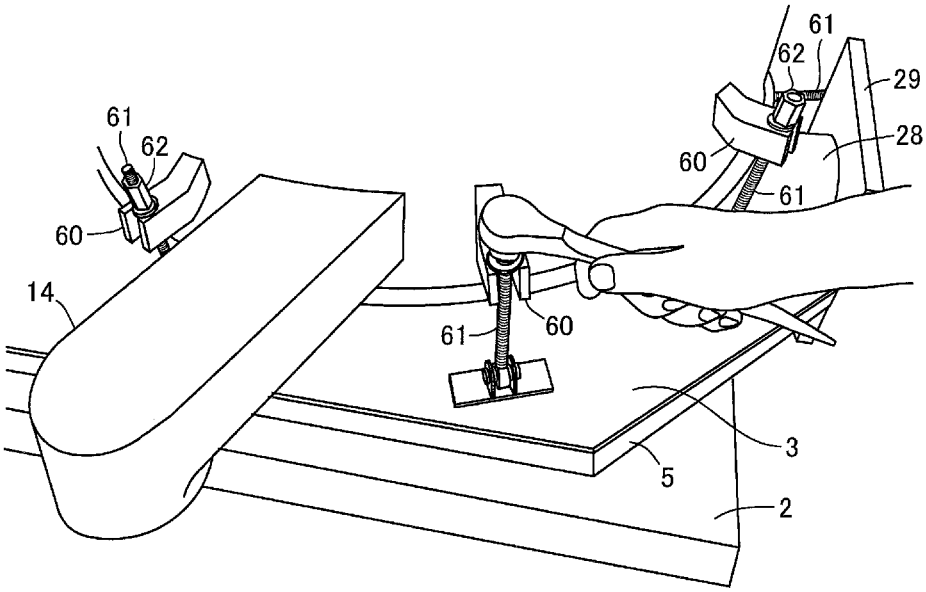

Next, as shown in FIG. 8A and FIG. 8B, the swing bolts 61 are successively swung into the vertical position and are thereby hooked on the respective hook brackets 60. The nuts 62 are screwed onto and fastened to the respective swing bolts 61, and sit on the respective hook brackets 60. The nuts 62 sitting on the hook brackets 60 are further fastened, so that axial forces are indirectly applied from the swing bolts 61 to the abutting portion of the upper separable sieve frame 7*a* and the lower separable sieve frame 7*b* through the separable sieve frames 7*a* and 7*b*, and the upper separable sieve frame 7*a* and the lower separable sieve frame 7*b* are thereby fastened together. Thus, the operation of attaching the sieve mesh 44 involved in the mesh replacement operation is completed, and the vibrating sieve machine 1A is ready to be used. At this time, the band diameter adjustment mechanism may be positioned to interfere with a member around the sieve frame 7 such as the swing bolt 61 when the vibrating sieve machine 1A is actuated. In this case, it is not necessary to disassemble the sieve frame 7 and rearrange the mesh member 40 so that the band diameter adjustment mechanism does not interfere with the swing bolt 61, which is a complicated operation. Instead, only the fastening band 45 is removed from the mesh member frame 42 by operating the spindle 49 so as to disengage the worm teeth of the spindle 49 from the worm grooves 50 in the band diameter adjustment mechanism 47, and the band diameter adjustment mechanism 47 is rearranged and attached again so as not to interfere with the swing bolt 61. Thus, the band diameter adjustment mechanism 47 can be easily prevented from interfering with the swing bolt 61.

<Operation of Classification Process>

Powder to be classified is placed inside the upper separable sieve frame 7*a* of the vibrating sieve machine 1A that is ready to be used after the sieve mesh 44 is attached thereto. Next, the lid 8 is attached to the upper separable sieve frame 7*a*, and both of them are fastened together by the fastening band 33. Thereafter, the opposite vibrating motors 30 are synchronously driven to apply vibrations to the powder to be classified that is placed on the mesh member 40 for sieving and classification.

A vibration component in the vertical direction and a vibration component in the horizontal direction are transmitted from the vibrating motors 30 to the sieve container 6. A wave motion generated by the vertical and horizontal vibrating motions of the sieve container 6 causes the powder on the mesh member 40 to significantly jump up and strike the meshes 43 and 44. As a result, powder particle aggregations are disintegrated or crushed and dispersed. The powder passed through the sieve mesh 44 by the classification process is discharged out through the outlet section 27 of the lower separable sieve frame 7*b*. Meanwhile, residual powder remaining on the sieve mesh 44 is discharged through the discharge duct 14 to the outside.

Figure 11:
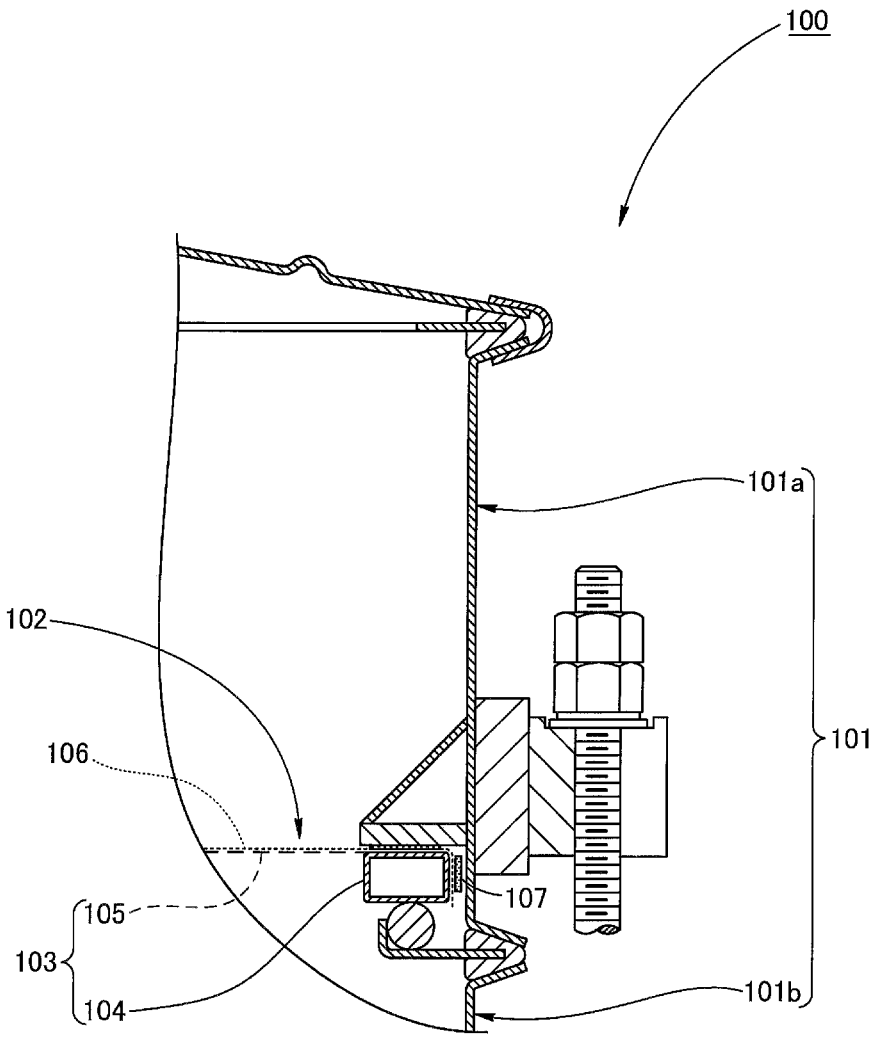
FIG. 11 is a diagram for describing a conventional technique.

In the vibrating sieve machine 1A of the first embodiment, the mesh member frame 42 is sandwiched by the separable sieve frames 7*a* and 7*b* with the outer peripheral surface of the mesh member frame 42 exposed outward in the radial direction of the separable sieve frames 7*a* and 7*b*. Therefore, compared to the conventional vibrating sieve machine 100 in which the mesh member frame 104, which does not substantially contribute to sieving and classification of powder to be classified, is entirely disposed inside the sieve frame 101 (the upper separable sieve frame 101*a*) (see FIG. 11), the effective areas of the reinforcement mesh 43 and the sieve mesh 44, which substantially contribute to powder sieving and classification, increase, and the fastening band 45 attached to the outer peripheral surface of the mesh member frame 42 is exposed outward in the radial direction of the separable sieve frames 7*a* and 7*b*. Therefore, powder to be classified can be more efficiently sieved and classified than in the conventional art, and the mesh member 40 and the sieve frame 7 can be fitted together without the fastening band 45 interfering with the sieve frame 7.

Second Embodiment

Figure 9:
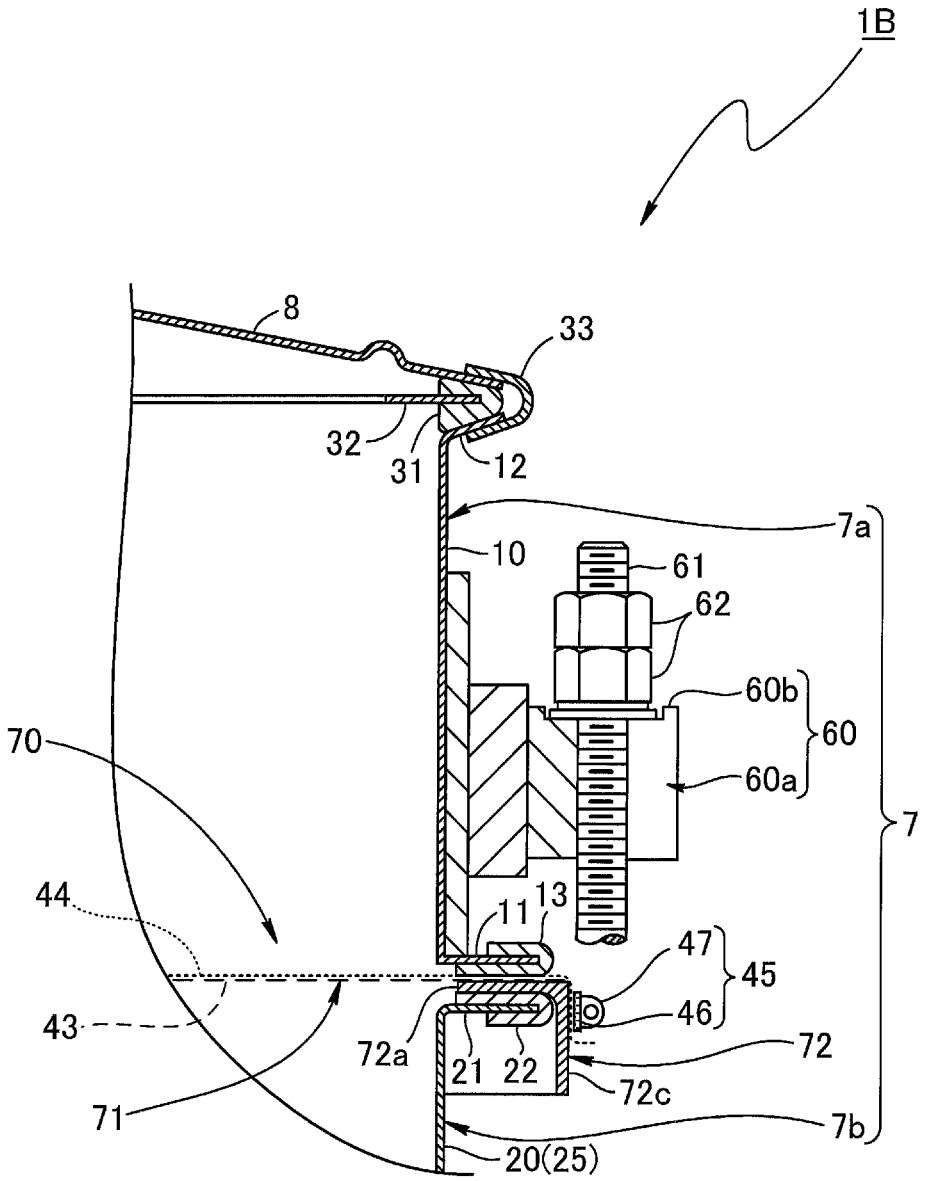
FIG. 9 is an enlarged cross-sectional view of a main portion of a vibrating sieve machine according to a second embodiment of the present invention.
Figure 10A:
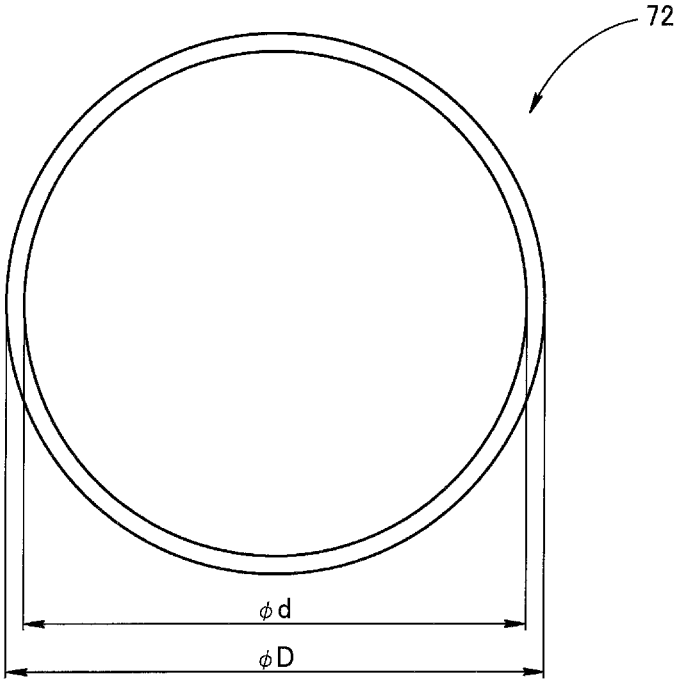
FIG. 10A, FIG. 10B and FIG. 10C are diagrams showing a mesh member frame used in the vibrating sieve machine of the second embodiment, including a plan view FIG. 10A thereof, a vertical cross-sectional view FIG. 10B thereof, and a schematic diagram FIG. 10C thereof for describing an operation of pulling a sieve mesh.
Figure 10B:
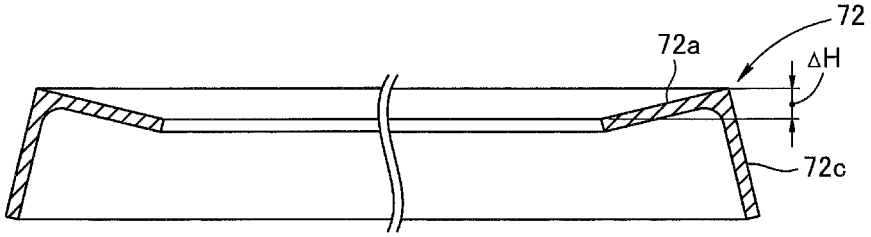
Figure 10C:
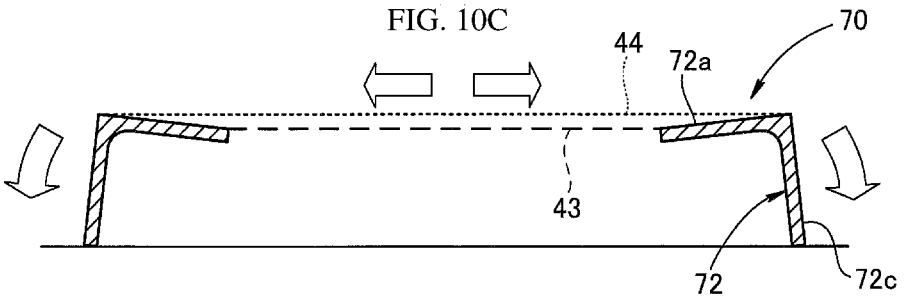

FIG. 9 is an enlarged cross-sectional view of a main portion of a vibrating sieve machine according to a second embodiment of the present invention. FIG. 10A, FIG. 10B and FIG. 10C are diagrams showing a mesh member frame used in the vibrating sieve machine of the second embodiment, including a plan view FIG. 10A thereof, a vertical cross-sectional view FIG. 10B thereof, and a schematic diagram FIG. 10C thereof for describing an operation of pulling a sieve mesh. Note that parts of the vibrating sieve machine of the second embodiment that are the same as or similar to those of the vibrating sieve machine of the first embodiment are indicated by the same reference characters and will not be described in detail. Parts specific to the vibrating sieve machine of the second embodiment will now be mainly described.

As shown in FIG. 9, in the vibrating sieve machine 1B of the second embodiment, a mesh member 70 includes a mesh member body 71 having a circular annular mesh member frame 72 and a reinforcement mesh 43 stretching across the frame 72. Here, the mesh member frame 72 has a circular annular plate surface portion 72*a* sandwiched by flanges 11 and 21 of separable sieve frames 7*a* and 7*b*, and an outer cylindrical portion 72*c* protruding downward from an outer peripheral edge of the circular annular plate surface portion 72*a*. The mesh member frame 72 is formed by bending an equal-angle steel (angle material) having an L-shaped cross-section into a circular ring, and welding the opposite ends of the steel together. Thus, the circular annular plate surface portion 72*a*, whose structure does not have a hollow portion, is sandwiched by the flanges 11 and 21 of the separable sieve frames 7*a* and 7*b* so that the mesh member 70 is fixed to the sieve frame 7. Therefore, when the mesh member 70 is fixed to the sieve frame 7, the mesh member frame 72 can be reliably prevented from being crushed and deformed to the extent that the mesh member can no longer be used. As a result, the tension of the sieve mesh 44 tied and fixed to the mesh member frame 72 can be prevented from being reduced due to the deformation of the mesh member frame 72. Note that the circular annular plate surface portion 72*a* corresponds to the "sandwich surface portion" of the present invention.

As shown in FIG. 10A, the mesh member frame 72 has an outer diameter (D) in the range of 400-1140 mm, and an inner diameter (d) in the range of 352-1080 mm.

As shown in FIG. 10B, the mesh member frame 72 is formed in a warped shape. Specifically, the circular annular plate surface portion 72*a*, which is to be sandwiched by the flanges 11 and 21 of the separable sieve frames 7*a* and 7*b*, is sloped upward as one progresses radially outward, i.e. in a direction away from the center of the mesh member frame 72. The magnitude of the warpage of the mesh member frame 72 is defined by a height difference ΔH between one end and the other end of the circular annular plate surface portion 72*a* in the radial direction of the mesh member frame 72. The height difference ΔH is 0.5-1.5 mm.

When the mesh member frame 72 having such a warpage is sandwiched by the flanges 11 and 21 of the separable sieve frames 7*a* and 7*b*, the mesh member frame 72 is deformed such that the warpage is eliminated. As a result, as shown in FIG. 10C, the entire sieve mesh 44 is pulled outward in the radial direction of the mesh member frame 72 with appropriate tension. As a result, the sieve mesh 44 that is put on top of the mesh member frame 72, covering the reinforcement mesh 43, is tightly attached to the reinforcement mesh 43 without being damaged and with high tension maintained. Therefore, the sieve mesh 44 is stably supported by the reinforcement mesh 43, and thereby exhibits sufficient classification performance. Thus, the vibrating sieve machine 1B of second embodiment has an advantageous effect similar to that of the vibrating sieve machine 1A of the first embodiment.

INDUSTRIAL APPLICABILITY

The vibrating sieve machine of the present invention can more efficiently sieve and classify powder to be classified than in the conventional art. In addition, the mesh member and the sieve frame can be fitted together without the fastening band interfering with the sieve frame. Therefore, the vibrating sieve machine of the present invention is suitably useful for classification process applications of powders of various materials, such as medicines, foods, mineral products, metals, and resin raw materials.

REFERENCE SIGNS LIST

1A, 1B vibrating sieve machine
7 sieve frame
7*a* upper separable sieve frame
7*b* lower separable sieve frame
10 upper separable sieve frame body
11 flange
13 packing
20 lower separable sieve frame body
21 flange
22 packing
40 mesh member
41 mesh member body
42 mesh member frame
42*a* upper circular annular plate surface portion (sandwich surface portion)
42*b* lower circular annular plate surface portion (sandwich surface portion)
42*c* outer cylindrical portion
42*d* inner cylindrical portion
43 reinforcement mesh
44 sieve mesh
45 fastening band
46 band member
47 band diameter adjustment mechanism
48 housing
49 spindle
50 worm groove
70 mesh member
71 mesh member body
72 mesh member frame
72*a* circular annular plate surface portion (sandwich surface portion)
72*c* outer cylindrical portion

What is claimed is:

1. A vibrating sieve machine comprising:

a sieve frame including a plurality of cylindrical separable sieve frames that are vertically separable from each other; and a mesh member configured to be held by the sieve frame, wherein vibrations are applied through the sieve frame to powder to be classified that is placed on the mesh member for sieving and classification, the mesh member includes a circular annular mesh member frame having a sandwich surface portion configured to be sandwiched by the separable sieve frames and an outer cylindrical portion provided at an outer peripheral edge of the sandwich surface portion, with an outer peripheral surface of the outer cylindrical portion exposed outward in a radial direction of the separable sieve frames, a reinforcement mesh stretching across the mesh member frame to block the opening of the mesh member frame, a sieve mesh configured to cover the reinforcement mesh, hanging down over the outer peripheral surface of the outer cylindrical portion in the mesh member frame from above the reinforcement mesh, and a fastening band configured to be attached to the outer peripheral surface of the outer cylindrical portion in the mesh member frame while being exposed outward in a radial direction of the separable sieve frames so as to sandwich the sieve mesh between the fastening band and the outer peripheral surface of the outer cylindrical portion in the mesh member frame.

2. The vibrating sieve machine of claim 1, wherein the mesh member frame has a warped shape such that the sandwich surface portion inclines upward in a radially outward direction from the center of the mesh member frame.

3. The vibrating sieve machine of claim 2, wherein the mesh member frame has an outer diameter of 400-1140 mm and an inner diameter of 352-1080 mm, and a magnitude of the warpage of the mesh member frame is defined by a height difference between one end and the other end of the sandwich surface portion in the radial direction of the mesh member frame, and the height difference is 0.5-1.5 mm.

4. The vibrating sieve machine of claim 1, wherein the fastening band includes a band member configured to be wrapped around the outer peripheral surface of the outer cylindrical portion in the mesh member frame so as to sandwich the sieve mesh between the band member and the outer peripheral surface of the outer cylindrical portion in the mesh member frame, and a band diameter adjustment mechanism attached to an outer peripheral surface of the band member and configured to adjust the size of a band diameter of the band member.

5. The vibrating sieve machine of claim 4, wherein the band diameter adjustment mechanism includes a housing attached to an end of the band member, a spindle rotatably supported by the housing and having worm teeth disposed in the housing, and a plurality of worm grooves disposed at the other end of the band member and configured to engage with the worm teeth, and the fastening band is allowed to be removed from the mesh member frame by operating the spindle so as to disengage the worm teeth from the worm grooves.

6. The vibrating sieve machine of claim 1, wherein the separable sieve frames include an upper separable sieve frame and a lower separable sieve frame configured to be disposed vertically adjacent to each other, the upper separable sieve frame has a body and a flange protruding from a lower end of the body radially outward, the lower separable sieve frame has a body and a flange protruding from an upper end of the body radially outward, and the flanges of the upper separable sieve frame and the lower separable sieve frame are configured to sandwich the mesh member frame.

7. The vibrating sieve machine of claim 6, further comprising:

a packing attached to each of the flanges of the upper separable sieve frame and the lower separable sieve frame and configured to be tightly attached to the mesh member.

8. A vibrating sieve machine comprising:

a sieve frame including a plurality of cylindrical separable sieve frames that are vertically separable from each other; and a mesh member configured to be held by the sieve frame, wherein vibrations are applied through the sieve frame to powder to be classified that is placed on the mesh member for sieving and classification, the mesh member includes a circular annular mesh member frame having an outer peripheral surface and configured to be sandwiched by the separable sieve frames with the outer peripheral surface exposed outward in a radial direction of the separable sieve frames, a reinforcement mesh stretching across the mesh member frame, a sieve mesh configured to cover the reinforcement mesh, hanging down over an outer peripheral surface of the mesh member frame, and a fastening band configured to be attached to the outer peripheral surface of the mesh member frame so as to sandwich the sieve mesh between the fastening band and the outer peripheral surface of the mesh member frame, wherein the fastening band includes a band member configured to be wrapped around the outer peripheral surface of the mesh member frame so as to sandwich the sieve mesh between the band member and the outer peripheral surface of the mesh member frame, and a band diameter adjustment mechanism attached to an outer peripheral surface of the band member and configured to adjust the size of a band diameter of the band member, wherein the band diameter adjustment mechanism includes a housing attached to an end of the band member, a spindle rotatably supported by the housing and having worm teeth disposed in the housing, and a plurality of worm grooves disposed at the other end of the band member and configured to engage with the worm teeth, and the fastening band is allowed to be removed from the mesh member frame by operating the spindle so as to disengage the worm teeth from the worm grooves.

9. A vibrating sieve machine comprising:

a sieve frame including a plurality of cylindrical separable sieve frames that are vertically separable from each other; and a mesh member configured to be held by the sieve frame, wherein vibrations are applied through the sieve frame to powder to be classified that is placed on the mesh member for sieving and classification, the mesh member includes a circular annular mesh member frame having an outer peripheral surface and configured to be sandwiched by the separable sieve frames with the outer peripheral surface exposed outward in a radial direction of the separable sieve frames, a reinforcement mesh stretching across the mesh member frame, a sieve mesh configured to cover the reinforcement mesh, hanging down over an outer peripheral surface of the mesh member frame, and a fastening band configured to be attached to the outer peripheral surface of the mesh member frame so as to sandwich the sieve mesh between the fastening band and the outer peripheral surface of the mesh member frame, wherein the mesh member frame has a sandwich surface portion configured to be sandwiched by the separable sieve frames, and the sandwich surface portion has a warped shape such that the sandwich surface portion inclines upward in a radially outward direction from the center of the mesh member frame, the mesh member frame has an outer diameter of 400-1140 mm and an inner diameter of 352-1080 mm, and a magnitude of warpage of the mesh member frame is defined by a height difference between one end and the other end of the sandwich surface portion in the radial direction of the mesh member frame, and the height difference is 0.5-1.5 mm.

10. A vibrating sieve machine comprising:

a sieve frame including a plurality of cylindrical separable sieve frames that are vertically separable from each other; and a mesh member configured to be held by the sieve frame, wherein vibrations are applied through the sieve frame to powder to be classified that is placed on the mesh member for sieving and classification, the mesh member includes a circular annular mesh member frame having an outer peripheral surface and configured to be sandwiched by the separable sieve frames with the outer peripheral surface exposed outward in a radial direction of the separable sieve frames, a reinforcement mesh stretching across the mesh member frame, a sieve mesh configured to cover the reinforcement mesh, hanging down over an outer peripheral surface of the mesh member frame, and a fastening band configured to be attached to the outer peripheral surface of the mesh member frame so as to sandwich the sieve mesh between the fastening band and the outer peripheral surface of the mesh member frame, wherein the mesh member frame has a sandwich surface portion configured to be sandwiched by the separable sieve frames, and the sandwich surface portion has a warped shape such that the sandwich surface portion inclines upward in a radially outward direction from the center of the mesh member frame.

* * * * *